US006833824B2

(12) United States Patent
Ide et al.

(10) Patent No.: US 6,833,824 B2
(45) Date of Patent: Dec. 21, 2004

(54) DRIVING METHOD FOR PLASMA DISPLAY PANEL

(75) Inventors: Kazuyoshi Ide, Tokyo (JP); Hiroshi Shirasawa, Tokyo (JP)

(73) Assignee: Pioneer Corporation (JP)

( * ) Notice: Subject to any disclaimer, the term of this patent is extended or adjusted under 35 U.S.C. 154(b) by 0 days.

(21) Appl. No.: 10/669,549

(22) Filed: Sep. 24, 2003

(65) Prior Publication Data

US 2004/0056606 A1 Mar. 25, 2004

Related U.S. Application Data

(63) Continuation of application No. 09/814,086, filed on Mar. 21, 2001.

(30) Foreign Application Priority Data

Mar. 23, 2000 (JP) ..... 2000-082576

(51) Int. Cl.[7] ..... G09G 3/28
(52) U.S. Cl. ..... 345/66; 345/60; 315/169.4
(58) Field of Search ..... 345/37, 41, 42, 345/60, 66–69; 315/169.3, 169.4

(56) References Cited

U.S. PATENT DOCUMENTS 5,786,794 A * 7/1998 Kishi et al. ..... 345/60
5,994,929 A * 11/1999 Sano et al. ..... 327/111
6,466,186 B1 * 10/2002 Shimizu et al. ..... 345/60
6,724,357 B2 * 4/2004 Kim et al. ..... 345/60
2002/0033806 A1 * 3/2002 Vossen et al. ..... 345/204

FOREIGN PATENT DOCUMENTS

| | | | |
|---|---|---|---|
| JP | 10-149135 | 6/1998 | |
| JP | 11-231829 | 8/1999 | ..... G09G/3/28 |
| JP | 11-344952 | 12/1999 | ..... G09G/3/28 |

* cited by examiner

*Primary Examiner*—Amare Mengistu
*Assistant Examiner*—Tom Sheng
(74) *Attorney, Agent, or Firm*—Hayes Soloway P.C.

(57) ABSTRACT

A charge-collecting circuit is connected between a clamping circuit on the side of the sustain electrodes and a clamping circuit on the side of the scan electrodes so as to be parallel to a capacitance between said sustain electrodes and said scan electrodes. In write-discharge, sustain-discharge, and the like, when a sustain-electrode potential staying at the level of the ground potential with a switch S2 being turned ON is to be increased to the level of the power potential that is the same as the level of a scan-electrode potential staying at the power potential with a switch S5 being turned ON, the switch S2 is first turned OFF, a current is then applied to flow from the scan-electrode to the sustain-electrode side to thereby slowly increase the potential on the side of the sustain electrodes in the charge-collecting circuit. Then, the switch S1 is subsequently turned ON, thereby, the sustain-electrode potential is clamped to the power potential at the same level as that of the scan-electrode potential.

4 Claims, 11 Drawing Sheets

DRIVING METHOD FOR PLASMA DISPLAY PANEL

CROSS REFERENCE TO RELATED APPLICATION

This application is a continuation of U.S. application Ser. No. 09/814,086, filed Mar. 21, 2001.

BACKGROUND OF THE INVENTION

1. Field of the Invention

The present invention relates to a driving method for a plasma display panel to be used when potentials of panel electrodes are varied to predetermined potentials in periods of time other than a period of time when charge-collection is performed.

2. Description of the Related Art

Generally, a plasma display panel has various advantages. For example, the panel can be constructed to be thin, no flickering occurs in display, the display contrast ratio is high, large-screen display can be relatively easily performed, the response speed is high, and multicolor light emission is enabled by use of emissive type phosphors. Therefore, in recent years, plasma display panels are widely used in the fields of, for example, public-use wide-screen displays and color televisions.

FIG. 1 is a circuit diagram showing a configuration of a conventional plasma display panel. As shown in FIG. 1, the plasma display panel includes a panel 608 for performing display light emission, and driver circuits for controlling display contents and display luminance of the panel 608.

A pair of primary electrodes is formed on the panel 608. One of the primary electrodes is formed of a set of scan electrodes 606-1 to **606-*n*, and the other one of the primary electrodes is formed of a set of sustain electrodes 605-1 to 605-*n*. The primary electrodes are formed mutually parallel to the horizontal direction of the panel. Data electrodes 607-1 to 607-N are formed perpendicular to (the vertical direction of) the primary electrodes. Pixels are to be formed at cross points of the primary electrodes and the data electrodes 607-1 to 607-N. Thereby, the pixels are to be formed in a matrix on the panel 608**.

A scan driver circuit 602 is connected to the scan electrodes 606-1 to **606-*n* to drive them. A sustain driver circuit 600 is connected to the scan driver circuit 602. The sustain driver circuit 600 outputs sustain pulses that sustain light emission of the panel 608. The scan driver circuit 602 and the sustain driver circuit 600 together form a scan-electrode driver circuit 612**.

The sustain electrodes 605-1 to **605-*n* are incorporated into a common sustain electrode. A sustain-electrode driver circuit 601 is connected to the incorporated common sustain electrode as well as to the scan driver circuit 602. The sustain driver circuit 601 outputs sustain pulses that sustain light emission of the panel 608. The sustain-electrode driver circuit 601 contains a charge-collecting circuit not shown) and a sustain driver circuit (not shown) that are series-connected to each other therein. One end of the charge-collecting circuit is connected to the scan driver circuit 602, and one end of the sustain driver circuit is connected to the common sustain electrode. Thereby, the charge-collecting circuit is parallel-connected to the panel 608, and the charge-collecting circuit and the capacitance between the set of the scan electrodes and the set of the sustain electrodes form a resonant circuit. Data-driver circuits 604*a* and 604*b* each drive N/2 of the data electrodes 607-1 to 607-N; and they are disposed at two end portions of the panel 608 that oppose each other on the same plane. The data driver circuits 604*a* and 604*b* are connected to the data electrodes 607-1 to 607**-N.

A scan-driver controller **609*a* is connected so to the scan driver circuit 602, a data-driver controller 610*a* is connected to the data-driver circuit 604*a*, and a sustain-driver controller 611*a* is connected to the sustain driver circuit 600. A controller circuit 603*a* is configured to include the scan-driver controller 609*a*, the data-driver controller 610*a*, and the sustain-driver controller 611*a*. Similarly, a scan-driver controller 609*b* is connected to the scan driver circuit 602, a data-driver controller 610*b* is connected to a data-driver circuit 604*b*, and a sustain-driver controller 611*b* is connected to the sustain-electrode driver circuit 601. A controller circuit 603*b* is configured to include the scan-driver controller 609*b*, the data-driver controller 610*b*, and the sustain-driver controller 611*b*. Scan-driver circuits 609*a* and 609*b* each control n/2 of outputs from the scan driver circuit 602 to the scan electrodes 601-1 to 601-*n***.

Hereinafter, a driving method for the conventional plasma display panel configured as described above will be described.

FIG. 2 is a timing chart regarding the scan electrodes 606-1 to **606-*n* and the sustain electrodes 605-1 to 605-*n* of the conventional plasma display panel shown in FIG. 1**.

First, an erase pulse is applied to the set of the scan electrodes 606-1 to **606-*n* to slowly reduce its potential and to generate erase discharges. Thereby, wall charges accumulated in the scan electrodes 606-1 to 606-*n*** are erased (a sustain erase period).

Subsequently, to obtain stabilized write-discharge characteristics in a scan period for selecting display pixels, active particles and wall charges are generated in a discharge gas space, First, a priming discharge pulse is applied to the scan electrodes 606-1 to **606-*n* to generate discharges at all the pixel on the panel 608 (a priming period). Subsequently, a priming discharge-erasing pulse is applied to the scan electrodes 606-1 to 606-*n*** for eliminating charges which impede write discharge and sustain discharge, among the wall charges generated through the aforementioned priming discharge (a priming erase period).

Specifically, first, in the priming period, the priming discharge pulse is applied to the scan electrodes 606-1 to **606-*n* to generate discharges at all the pixels. Subsequently, in the priming erase period, the sustain-electrode 605-1 to 605-*n*-side potential is increased to a sustain voltage level Vs. Concurrently, the priming discharge-erasing pulse for slowly reducing the potential caused by the priming discharge pulse is applied to the scan electrodes 606-1 to 606-*n*** to cause them to generate erase discharges. Thereby, stored wall charges caused by the priming discharge pulse are erased.

Subsequently, sequential scanning pulses are applied to the scan electrodes 606-1 to **606-*n*. In synchronization with the scanning pulses, data pulses are selectively applied to the data electrodes 607-1 to 607**-N of pixel to be displayed. In this manner, write discharges are generated at portions of pixel to be displayed to thereby create wall charges (a scan period).

Subsequently, voltages are alternately applied between the scan electrodes 606-1 to **606-*n* and the sustain electrodes 605-1 to 605-*n*; and discharges generated thereby are used to perform display operation (a sustain period). The luminance of the display is determined according to the number of repetitions of the alternate voltage application performed between the scan electrodes 606-1 to 606-*n* and the sustain electrodes 605-1 to 605-*n***.

Hereinafter, a description will be made regarding a control method for potentials of the scan electrodes and the sustain electrodes of the above-described plasma display panel.

FIG. 3 is a circuit diagram showing a conventional sustain driver circuit in the plasma display panel. As shown in FIG. 3, a switch S1 for clamping a sustain-electrode 605-1 to **605-*n*-side potential to a power voltage is series-connected to a switch S2 provided for clamping the sustain-electrode 605-1 to 605-*n*-side potential to a ground potential. A clamping circuit on the sustain-electrode side is formed of the switches S1 and S2. A circuit line including a switch S7 and a resistor R1 for slowly increasing the sustain-electrode 605-1 to 605-*n*-side potential is series-connected to a circuit line including a switch S8 and a resistor R2 for slowly reducing the sustain-electrode 605-1 to 605-*n*-side potential. A slope circuit on the sustain-electrode side is formed of the switches S7 and S8 and resistors R1 and R2. A cross point B is connected to a cross point of a circuit line including the switch S7 and the resistor R1 and a circuit line including the switch S8 and the resistor R2. A sustain driver circuit 101 it formed of these clamping circuit and slope circuit on the sustain-electrode side. The sustain-driver controller 611*a* controls switching of the sustain driver circuit 101; and the clamped potential is commonly output to the sustain electrodes 605-1 to 605-*n* from an electrode X shown in FIG. 1**.

In addition, a coil L1 is connected to the cross point B of the switch S1 and the switch S2. A reverse-current preventing diode D1 and a switch S3 and a circuit line including a reverse-current preventing diode D2 (in the reverse direction of the diode D1) and a switch S4 are parallel-connected to the coil L1. A charge-collecting circuit 102 is formed of the switches S3 and S4, diodes D1 and D2, and the coil L1. The circuit 102 controls charge-collection between the scan electrodes 606-1 to **606-*n* and the sustain electrodes 605-1 to 605-*n*. The sustain-electrode driver circuit 601 shown in FIG. 1 is formed of the sustain driver circuit 101 and the charge-collecting circuit 102**.

A switch S5 for clamping the scan electrodes 606-1 to **606-*n* to the potential of a power voltage Vs is series-connected to a switch 66 provided for clamping the scan electrodes 606-1 to 606-*n* to a ground potential. A charge-collecting circuit 620 is connected to a cross point A. A clamping circuit on the scan-electrode side is formed of the switches S5 and S6. A circuit line including a switch S9 and a resistor R3 for slowly increasing the scan-electrode 606-1 to 606-*n*-side potential is series-connected to and a circuit line including a switch S10 and a resistor R4 for slowly reducing the scan-electrode 606-1 to 606-*n*-side potential. A slope circuit on the scan-electrode side is formed of the switches S9 and S10 and resistors R3 and R4. The cross point A is connected to a cross point of the circuit line including the switch S9 and the resistor R3 and the circuit line including the switch S10 and the resistor R4. The sustain driver circuit 600 shown in FIG. 1 is formed of these clamping circuit and slope circuit on the scan-electrode side. The sustain-driver controller 611*b* controls switching of the sustain driver circuit 600; and the clamped voltage is output to the scan electrodes 606-1 to 60-*n* from an electrode Y shown in FIG. 1 via the scan driver circuit 602**.

As described above, the charge-collecting circuit is parallel-connected to the panel; and a resonant circuit is formed of the charge-collecting circuit and the capacitance between the scan electrodes and the sustain electrodes (panel capacitance). The sustain driver circuit 600 (formed of the switches S5, S6, S9, and S10, and resistors R3 and R4) and the scan driver circuit 602 are included in a scanning package 111. The sustain-electrode driver circuit 601 (formed of the sustain driver circuit 101 and the charge-collecting circuit 102) is included in a common package 112.

First, a description will be made regarding a charge-collecting method in the driver circuits configured as described above. FIG. 4 is a timing chart that shows the potentials of the scan-electrode and sustain-electrode and operations of switches S1 to S10 when charge-collection is performed by the sustain driver circuit 600 and the sustain-electrode driver circuit 601 (shown in FIG. 3) in either the sustain erase period shown with reference numeral 101 shown in FIG. 2 or the sustain period.

First, an initial state is assumed such that each of the switches S2 and S5 is in an ON state Thereby, the scan-electrode potential (point A) is set to the potential of the power voltage Vs, and the sustain-electrode side (point B) is set to the ground potential. Also, each of the switches S3, S4, and S7 to S10 is assumed to be in an OFF state.

In the above initial state, the switches S2 and S5 are first set to an OFF state, and the switch S3 is then set to an ON state. As a result, a current flows from the scan-electrode side to the sustain-electrode side through the switch S3, the diode D1, and the coil L1. This causes the scan-electrode potential level to decrease, and causes the sustain-electrode potential level to increase. Skews of curved lines representing the decrease and increase in the potential levels are dependent on the coil L1, the parasitic inductance thereof, and inter-panel-electrode capacitance and parasitic capacitance.

After the scan-electrode potential level decreases to a certain level, and the sustain-electrode potential level increases to a certain level, the switches S1 and S6 are turned ON, and concurrently, the switch S3 is turned OFF. Thereby, the scan-electrode potential level is clamped to the ground potential, and concurrently, the sustain-electrode potential level is clamped to the potential of the power voltage Vs.

Subsequently, the switches S1 and S6 are first turned OFF, and the switch S4 is then turned ON. As a result, a current flows from the sustain-electrode side to the scan-electrode side through the coil L1, the diode D2, and the switch S4. This causes the sustain-electrode potential level to decrease, and causes the scan-electrode potential level to increase.

After the sustain-electrode potential level decreases to a certain level, and the scan-electrode potential level increases to a certain level, the switches S2 and S5 are turned ON, and concurrently, the switch S4 is turned OFF. Thereby, the sustain-electrode potential is clamped to the ground potential, and concurrently, the scan-electrode potential is clamped to the potential of the power voltage Vs.

As in the above-described manner, the sustain driver circuit 600 and the sustain-electrode driver circuit 601 control the switches S1, S2, S5, and S6 in the resonant circuits and the clamping circuits so that the scan-electrode potential is replaced with the sustain-electrode potential. Thereby, self-collection of charges stored in the panel 608 is performed between the scan electrodes and the sustain electrodes through the charge-collecting circuit.

Hereinafter, a description will be made regarding a driving method to be implemented when either the scan-electrode potential or the sustain-electrode potential is varied to either the potential of the power voltage Vs or the round potential. Description refers to an example wherein, as shown by reference numeral 102 shown in FIG. 2, the sustain-electrode potential set to the ground potential is increased to the power voltage Vs in the priming erase period or the like.

FIG. 5 is a timing chart that shows the potentials of the scan-electrode and sustain-electrode and operations of switches S1 to S10 when the sustain driver circuit 600 and the sustain-electrode driver circuit 601 that are shown in FIG. 3 are used to increase the sustain-electrode potential set to the ground potential to the potential of the power voltage Vs.

An initial state is assumed such that each of the switches S2 and S5 is in the ON state. Thereby, the scan-electrode side (point A) is set to the potential of the power voltage Vs, and the sustain-electrode side (point B) is set to the ground potential.

After the switch S2 is turned OFF, the switch S7 is turned ON. As a result, the sustain-electrode potential slowly increases according to the operation of the resistor R1. After the potential increases to a certain level, the switch S1 is turned ON, and concurrently, the switch S7 is turned OFF. Thereby; the sustain-electrode potential is clamped to the potential of the power voltage Vs.

In the above case, in the sustain electrodes and the scan electrodes, when the potential thereof is sharply varied, problems such as undershoot and overshoot may occur to cause a state beyond component-rating tolerances. To cope with the problems, to vary either the sustain-electrode potential or the scan-electrode potential, the slope circuits as described above need to be used to slowly vary the potential in the period other than a period of collecting charges.

Thus, in the conventional sustain driver circuit 600 and the sustain driver circuit in the sustain-electrode driver circuit that are shown in FIG. 3, to vary either the scan-electrode potential or the sustain-electrode potential to a predetermined potential, the slope circuits are first used to slowly vary the potential. Subsequently, after the potential varies to a certain level, the clamping circuits are used to clan the potential to the predetermined potential.

In recent years, for plasma display panels, improvement in the performance and reduction in the cost are increasingly demanded. To comply with the demand, the performance is required to be improved in a circuit configuration maximally simplified.

However, according to the above-described conventional driving method of the conventional plasma display panel, to vary either the scan-electrode potential or the sustain-electrode potential to a predetermined potential, the slope circuits need to be used to slowly vary the potential; and subsequently, after the potential varies to a certain level, the clamping circuits are used to clamp the potential to the predetermined potential. Therefore, the conventional method requires the provision of the slope circuits for slowly varying the potential. Thus, the circuit cannot be miniaturized overall.

SUMMARY OF THE INVENTION

An object of the present invention is to provide a driving method for a plasma display panel in which potentials of electrodes can be slowly varied without slope circuits, and driver circuits can be simplified in configuration to thereby allow the cost to be reduced.

As a first aspect, the present invention provides a driving method (first driving method) for a plasma display panel which comprises:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit for clamping a first electrode which is one of said scan electrodes and said sustain electrodes, to a predetermined potential;

a second clamping circuit for clamping a second electrode which is the other one of the said scan electrodes and said sustain electrodes, to a predetermined potential; and a charge-collecting circuit connected between said first clamping circuit and said second clamping circuit to perform charge-collection between said scan electrodes and said sustain electrodes.

In said driving method for a plasma display panel, after a write-discharge is generated between said scan electrode and said data electrode at said display cell, a voltage is applied to said scan electrode and said sustain electrode to thereby sustain said discharge.

Said first driving method transfers the potential clamped in said second clamping circuit to said first electrodes through said charge-collecting circuit to thereby vary the potential of the first electrodes to the same level of the potential as that of said second electrodes.

The first driving method may be arranged such that, when a potential of the first electrode is higher than a potential of the second electrode, a current is applied to flow from the first set of electrodes to the second set of electrodes through the charge-collecting circuit according to the difference between the potential of the first electrode and the potential of the second electrode to thereby vary the potential of the first electrode to be the same level as that of the potential of the second electrode.

Also, the first driving method may be arranged such that, when a potential of the first electrode is lower than a potential of the second electrode, a current is applied to flow from second electrode to the first electrode through the charge-collecting circuit according to the difference between the potential of the first electrodes and the potential of the second electrode to thereby vary the potential of the second electrode to the same level as that of the potential of the first electrode.

As a second aspect, the invention provides a driving method (second driving method) for a plasma display panel which comprises:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit that has a first switching element for elating a first electrode which is one of said scan electrodes and said sustain electrodes to a power potential and a second switching element for clamping said first electrodes to a ground potential, and that clamps said first electrode to a predetermined potential;

a second clamping circuit that comprises a fifth switching element for clamping a second electrode which is the other one of said scan electrodes and said sustain electrodes to a power potential and a sixth switching element for clamping said second electrode to a ground potential, and that clamps said second electrodes to a predetermined potential; and a charge-collecting circuit that comprises a first circuit line and a second circuit line, said first circuit line being formed to include a first coil, a first diode, and a third switching element that series-connected to each other and to thereby allow a current to flow from said second clamping circuit to said first clamping circuit, and said second circuit line being formed to include a second coil, a second diode, and a fourth switching element which are series-connected to each other and to thereby allow a current to flow to said second clamping circuit, and that is connected between said first clamping circuit and said second clamping circuit in parallel to an inter-electrode capacitance between said first electrode and said second electrode, thereby performs charge-collection between said scan electrodes and said sustain electrodes.

After a write-discharge is generated between said scan electrode and said data electrode at said display cell, a voltage in applied to said scan electrode and said sustain electrode to thereby sustain said discharge.

The second driving method transfers the potential clamped in said second clamping circuit to said first electrode through said charge-collecting circuit to thereby vary the potential of the first electrode to the same level of the potential as that of said second electrode.

The second driving method may be arranged such that, when the potential of the first electrode stays at the ground potential, and the potential of the second electrode stays at the power potential, the driving method comprises the steps of: setting the second switching element to an OFF state; setting the third switching element to an ON state to thereby allow a current to flow to the first circuit line; and setting the first switching element to an ON state to thereby increase the potential of the first set of electrodes to the level of the power potential.

Also, the second driving method may be arranged such that, when the potential of the first electrode stays at the power potential, and the potential of the second electrode stays at the ground potential, the driving method comprises the steps of: setting the sixth switching element to an OFF state; setting the fourth switching element to an ON state to thereby allow a cent to flow to the second circuit line; and setting the fifth switching element to an ON state to thereby increase the potential of the second set of electrodes to the level of the power potential.

Furthermore, the second driving method may be arranged such that, when the potential of the first electrode stays at the power potential, and the potential of the second set of electrodes stays at the ground potential, the driving method comprises the steps of: setting the first switching element to an OFF state; setting the fourth switching element to an ON state to thereby allow a current to flow to the second circuit line; and setting the second switching element to an ON state to thereby reduce the potential of the first set of electrodes to the level of the power potential.

Still furthermore, the second driving method may be arranged such that, when the potential of the first electrode stays at the ground potential, and the potential of the second electrode stays at the power potential, the driving method comprises the steps of; setting the fifth switch device to an OFF state; setting the third switching element to an ON state to thereby allow a current to flow to the first circuit line; and setting the sixth switching element to an ON state to thereby reduce the potential of the second set of electrodes to the level of the power potential.

As a third aspect, the invention provides a driving method (third driving method) for a plasma display panel which comprises: a charge-collecting circuit that has coils and a plurality of switches, that is parallel-connected to a capacitance between a set of scan electrodes and a set of sustain electrodes of said plasma display panel, and that uses a resonant current generated at the time of discharge of the capacitance between the set of said scan electrodes and the set of said sustain electrodes to thereby perform recharge of the capacitance between the set of said scan electrodes and the set of said sustain electrodes in reverse polarity; and first and second driver circuits that individually has two switches each for performing connection to a power supply or a ground, that clamp voltages of two ends of the capacitance between the set of said scan electrodes and the set of said sustain electrodes to a power voltage or a ground voltage, and that are individually connected to the two ends of the capacitance between the set of said scan electrodes and the set of said sustain electrodes, wherein a parallel resonant circuit is formed of the capacitance between the set of said scan electrodes and the set of said sustain electrodes and the charge/discharge circuit portion.

Said third driving method transfers a potential that a first electrode which is one of said scan electrodes and said sustain electrodes has been clamped by said first clamping circuit to a second electrode which is the other one of said scan electrodes and said sustain electrodes through said charge-collecting circuit to thereby vary the potential of said second electrode to the level of that of said first electrode.

According to the present invention, in the plasma display panel configured to include the sustain electrodes and the scan electrodes, to increase a sustain-electrode potential staying at the ground potential to the level of the power potential, if the scan-electrode potential stays at the power potential, the scan-electrode potential is transferred to the sustain-electrode side through the charge-collecting circuit that performs charge-collection between the sustain electrodes and the scan electrodes. Thereby, the sustain-electrode potential is increased to the level of the power potential.

To increase a scan-electrode potential staying at the ground potential to the level of the power potential, if the sustain-electrode potential stays at the level of the power potential, a current is applied to flow from the sustain-electrode side to the scan-electrode side through the charge-collecting circuit that performs charge-collection between the sustain electrodes and the scan electrodes. Thereby, the scan-electrode potential is increased to the level of the power potential.

To reduce a sustain-electrode potential staying at the power potential to the level of the ground potential, if the scan-electrode potential stays at the ground potential, the sustain-electrode potential is transferred to the scan-electrode side through the charge-collecting circuit that perform charge-collection between the sustain electrodes and the scan electrodes. Thereby, the sustain-electrode potential is reduced to the level of the ground potential.

To reduce a scan-electrode potential staying at the power potential to the level of the ground potential, if the sustain-electrode potential stays at the level of the power potential, a current is applied to flow from the scan-electrode side to the sustain-electrode side through the charge-collecting circuit that performs charge-collection between the sustain electrodes and the scan electrodes. Thereby, the scan-electrod potential is reduced to the level of the ground potential.

As described above, either when the potential is transferred through the charge-collecting circuit or when the current is applied to flow through the charge-collecting circuit, the potential on the electrode side where the potential is varied is slowly varied dependent on the coil, the parasitic inductance thereof, and the capacitance between the set of the scan electrodes and the set of the sustain electrodes and parasitic capacitance. Therefore, as described above, when one of the sustain-electrode potential and the scan-electrode potential is varied to the same level as that of the potential of the other one of the electrode sides, the potential clamped in the clamping circuit on the other one of the electrode sides is transferred through the charge-collecting circuit, or the current is applied to flow to the other one of the electrode sides through the charge-collecting circuit. Thereby, the potential can be slowly varied. Therefore, the driving method of the present invention avoids the necessity for the provision of slope circuits for varying potentials.

DETAILED DESCRIPTION OF THE PREFERRED EMBODIMENT

Figure 6:
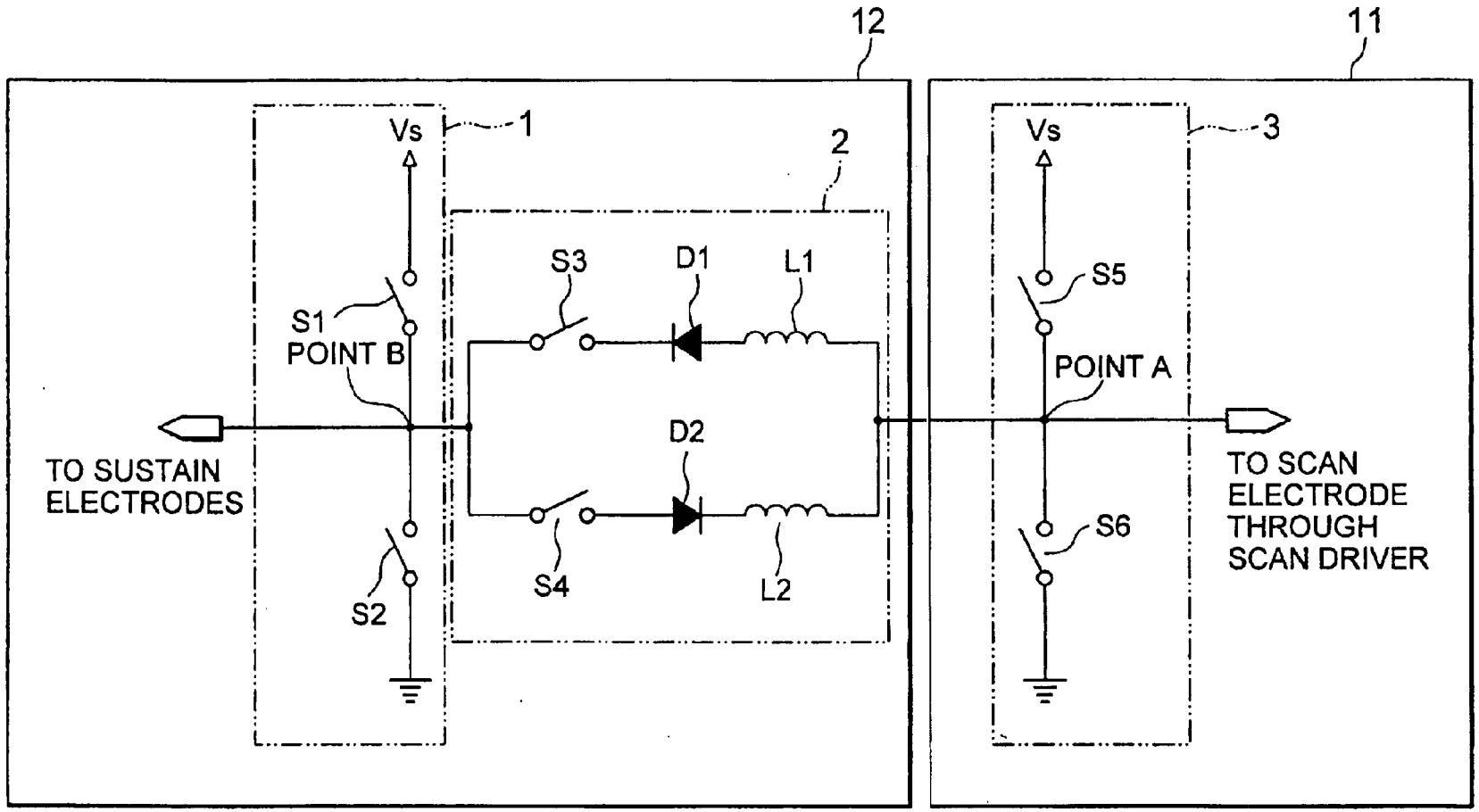
FIG. 6 is a circuit diagram of a sustain driver circuit of a plasma display panel according to the present invention

Hereinafter, referring to the accompanying drawings, a description will be made regarding a driving method for a plasma display panel according to an embodiment of the present invention. FIG. 6 is a circuit diagram of a sustain driver circuit of a plasma display panel according to the present invention. The plasma display panel of the present embodiment is configured similar to that shown in FIG. 1. A sustain driver circuit shown in FIG. 6 is an embodiment of a set of the sustain driver circuit 600 and the sustain-electrode driver circuit 601.

As shown in FIG. 6, a switch S1 (first switching element) for clamping the sustain-electrode 605-1 to **605-*n*-side potential to a potential of a power voltage Vs is series-connected to a switch S2 (second switching element) provided for clamping the sustain-electrode 605-1 to 605-*n*-side potential to a ground potential. A cross point B of a circuit line including the switch S1 and a circuit line including the switch S2 is connected to the point X (electrode) shown in FIG. 1. The switches S1 and S2 together form a clamping circuit 1 on the sustain-electrode side as a first clamping circuit (sustain driver circuit) for clamping the sustain-electrode 605-1 to 605-*n***-side potential to either the power potential or the ground potential.

A switch S5 (fifth switching element) for clamping the scan-electrode 606-1 to **606-*n*-side potential to the potential of the power voltage Vs is series-connected to a switch S6 (sixth switching element) provided for clamping the scan-electrode 606-1 to 606-*n*-side potential to the ground potential. A cross point A of a circuit line including the switch S5 and a circuit line including the switch S6 is connected to the point Y shown in FIG. 1. The switches S5 and 66 together form a scan-electrode clamping circuit 3 as a second clamping circuit (sustain driver circuit) for clamping the scan-electrode 606-1 to 606-*n***-side potential to either the power potential or the ground potential.

A switch S3 (third switching element), a first diode D1 for preventing reverse current flows, and a first coil L1 are series-connected together between the cross points B and A. A switch S4 (fourth switching element), a second diode D2 for preventing reverse-current flows (in the reverse direction of the diode D1), and a second coil L2 are series-connected together between the cross points B and A. A circuit line including the switch S3, the diode D1, and the coil L1 for allowing current to flow from the cross point A to the cross point B, and a circuit line including the switch S4, the diode D2, and the coil L2 for allowing current to flow from the cross point B to the cross point A are provided in parallel to a capacitance (panel 608) between the set of the sustain electrodes and the set of the scan electrodes. A charge-collecting circuit 2 is formed to include the switches S3 and S4, the diodes D1 and D2, and the coils L1 and L2. In addition, the sustain-electrode driver circuit shown in FIG. 1 is formed of the sustain driver circuit 1 and the charge-collecting circuit 2.

Figure 1:
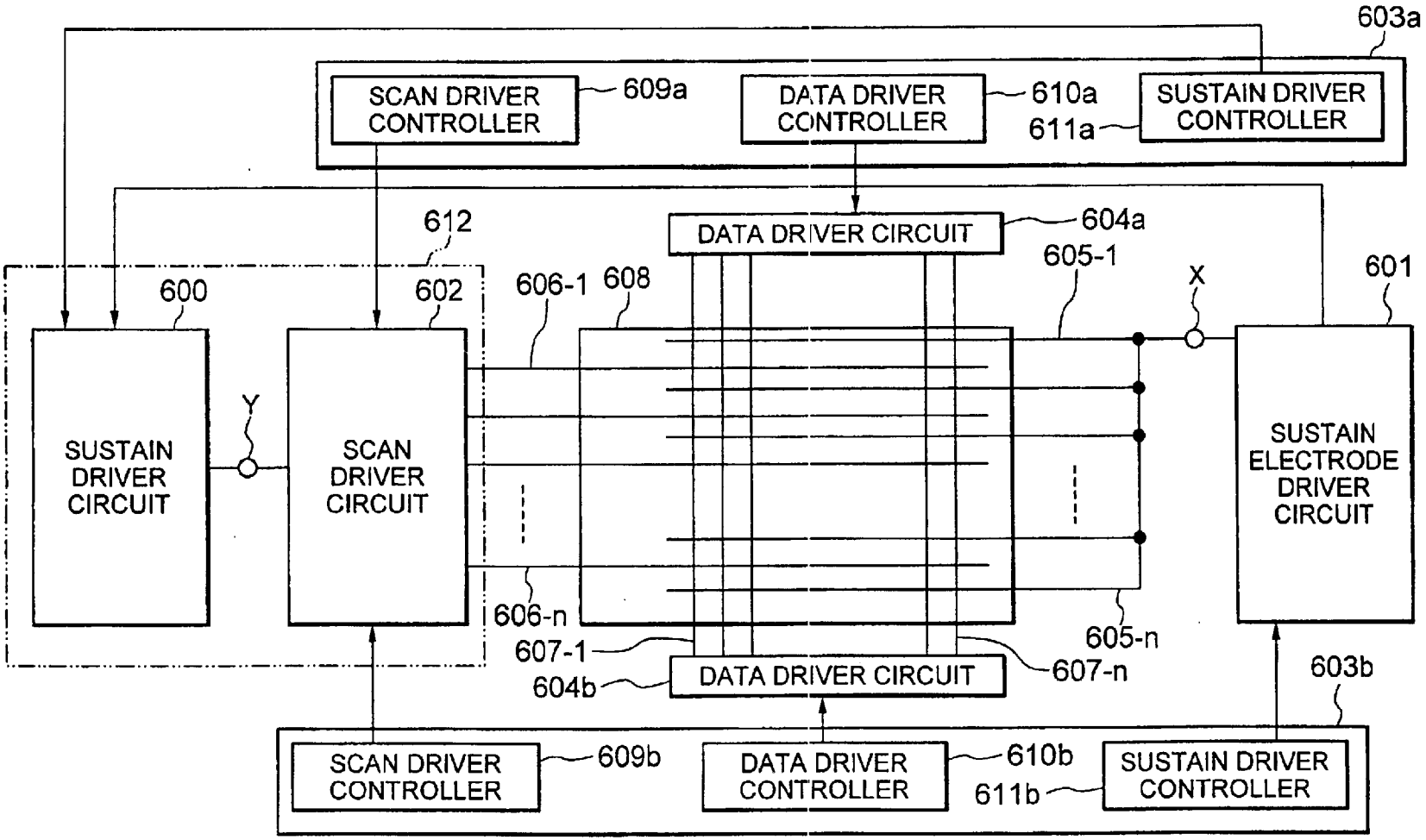
FIG. 1 (PRIOR ART)
FIG. 1 shows an example of a configuration of an ordinary plasma display panel.

The clamping circuit 3, which is formed of the switches S5 and S6, and the scan driver circuit 602 shown in FIG. 1 are included in a scanning package 11. Other components, i.e., the clamping circuit 1 and the charge-collecting circuit 2 (sustain-electrode driver circuit) are included in a common package 12.

In the sustain driver circuit and the sustain-electrode driver circuit, which are configured as described above, the charge-collecting circuit 2 controls charge-collection between the scanning electrodes 606-1 to **606-*n* and the sustain electrodes 605-1 to 605-*n*. The sustain-electrode potential is clamped to either the potential of the power voltage Vs or the ground potential according to an ON or OFF operation of the switches S1 and S2 of the clamping circuit 1. The scan-electrode potential is clamped to either the potential of the power voltage Vs or the ground potential according to an ON or OFF operation of the switches S5 and S6**.

Figure 7:
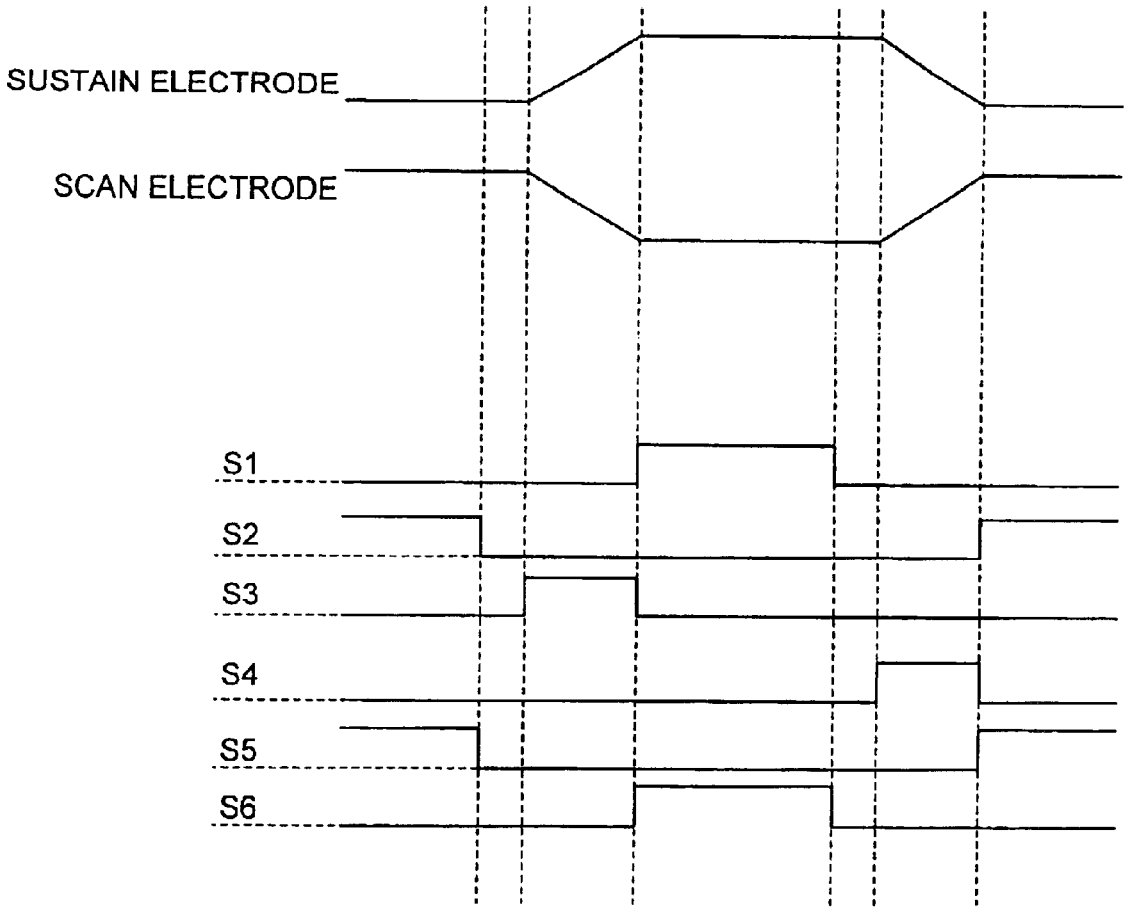
FIG. 7 is a timing chart that shows the potentials of the scan-electrode and sustain-electrode and operations of switches S1 to S6 when charge-collection is performed by the sustain driver circuit and a sustain-electrode driver circuit that are shown in FIG. 6.

Hereinafter, a description will be made regarding a charge-collecting method to be performed in the sustain driver circuit and the sustain-electrode driver circuit that are configured as described above. FIG. 7 is a timing chart that shows the potentials of the sustain-electrode and scan-electrode and operations of switches S1 to S6 when charge-collection is performed by the sustain driver circuit and the sustain-electrode driver circuit that are shown in FIG. 6.

An initial state is assumed such that each of the switches S2 and S5 is in an ON state. Thereby, the scan-electrode side (point A) is set to the potential of the power voltage Vs, and the sustain-electrode (point B) is set to the ground potential.

In the above initial state, the switches S2 and S5 are first set to an OFF state, and the switch S3 is then turned ON. As a result, a current flows from the scan-electrode side to the sustain-electrode side through the coil L1, switch S3, the diode D1, and the switch S3. This causes the scan-electrode potential level to decrease, and causes the sustain-electrode potential level to increase. Skews of curved lines representing the decrease and increase in the potential levels are dependent on the coil L1, the parasitic inductance thereof, and inter-panel-electrode capacitance and parasitic capacitance.

After the scan-electrode potential level decreases to a certain level, and the sustain-electrode potential level increases to a certain level, the switches S1 and S6 are turned ON, and concurrently, the switch S3 is turned OFF. Thereby, the scan-electrode potential is clamped to the ground potential, and concurrently, the sustain-electrode potential is clamped to the potential of the power voltage vs.

Subsequently, the switches S1 and 56 are first turned OFF, and the switch S4 is then turned ON. As a result, a current flows from the sustain-electrode side to the scan-electrode side through the switch S4, the diode D2, and the coil L2. This causes the sustain-electrode potential level to decrease, and causes the scan-electrode potential level to increase.

After the sustain-electrode potential level decreases to a certain level, and the scan-electrode potential level increases to a certain level, the switch S2 and S5 are turned ON, and concurrently, the switch S4 is turned OFF. Thereby, the sustain-electrode potential is clamped to the ground potential, and concurrently, the scan-electrode potential is clamped to the potential of the power voltage Vs.

As in the above-described manner, the scan-electrode potential is replaced with the sustain-electrode potential by controlling switches S1 and S6. Thereby, self-collection of charges is performed between the scan electrodes and the sustain electrodes through the charge-collecting circuit.

Hereinafter, a description will be made regarding a driving method to be implemented when either the scan-electrode potential or the sustain-electrode potential is varied to either the potential of the power voltage Vs or the ground potential.

Figure 8:
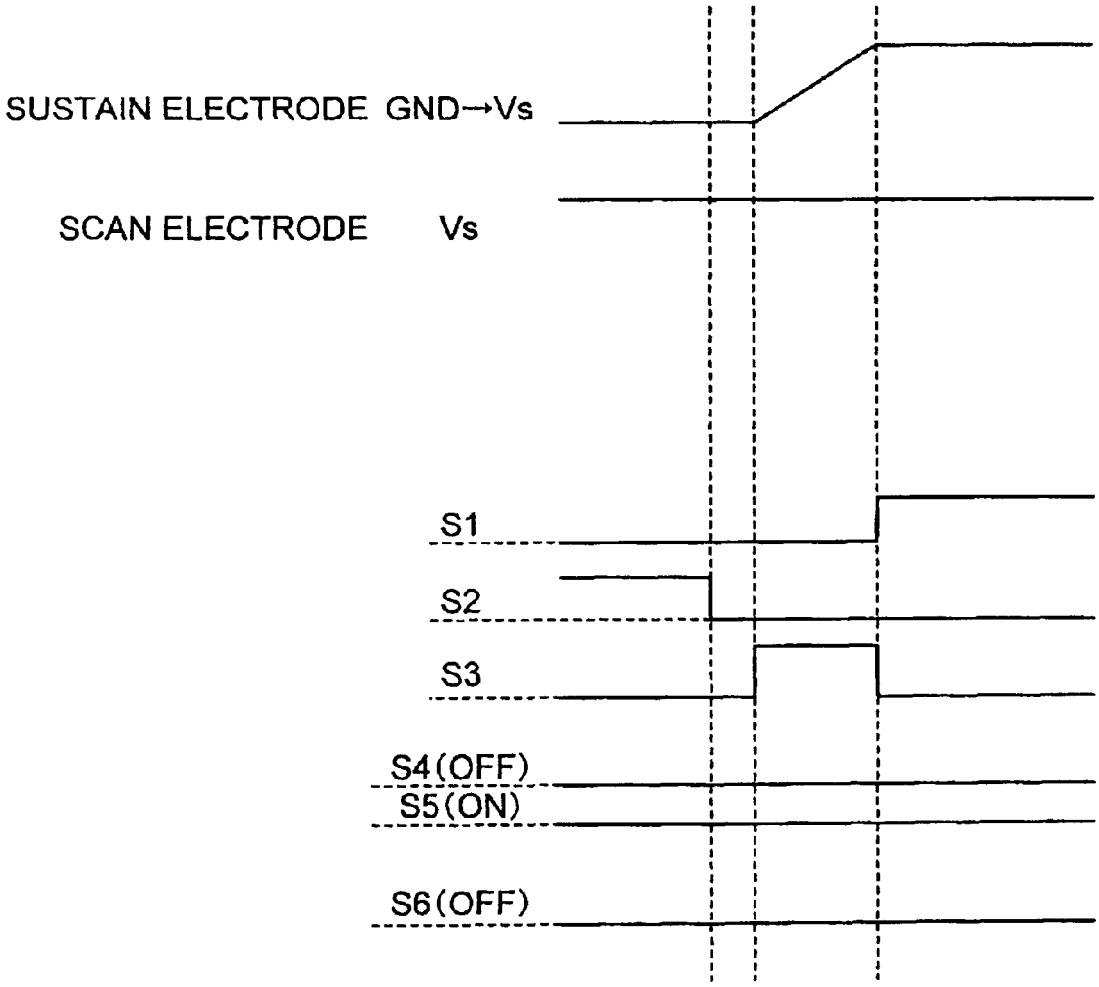
FIG. 8 is a timing chart that shows the potentials of the sustain-electrode and scan-electrode and operations of switches S1 to S6 when the sustain driver circuit and the sustain-electrode driver circuit that are shown in FIG. 6 are used to increase the sustain-electrode potential staying at a ground potential to the potential of a power voltage Vs that is the same as that one side of the scan electrodes.

FIG. 8 is a timing chart that shows the potentials of the sustain-electrode and scan-electrode and operations of switches S1 to S6 when the sustain driver circuit and the sustain-electrode driver circuit that are shown in FIG. 6 are used to increase the sustain-electrode potential staying at a ground potential to the potential of a power voltage Vs that is the same as that one side of the scan electrodes.

An initial state is assumed such that each of the switches S2 and S5 is in an ON state. Thereby, the scan-electrode side (point A) is set to the potential of the power voltage Vs, and the sustain-electrode side (point B) is set to the ground potential.

In the above state, the switch S2 is turned OFF, and the switch S3 is then turned ON. As a result, a current flows from the scan-electrode side to the sustain-electrode side through the coil L1, the diode D1, and the switch S3. Thereby, the sustain-electrode potential is slowly increased. The increase in the sustain-electrode potential is slow because of effects of the coil L1 and parasitic inductance thereof and inter-panel-electrode capacitance and parasitic capacitance.

After the sustain-electrode potential is increased to a certain level, the switch S1 is turned ON, and concurrently, the switch S3 is turned OFF. Thereby, the sustain-electrode potential is clamped to the potential of the power voltage Vs.

Figure 9:
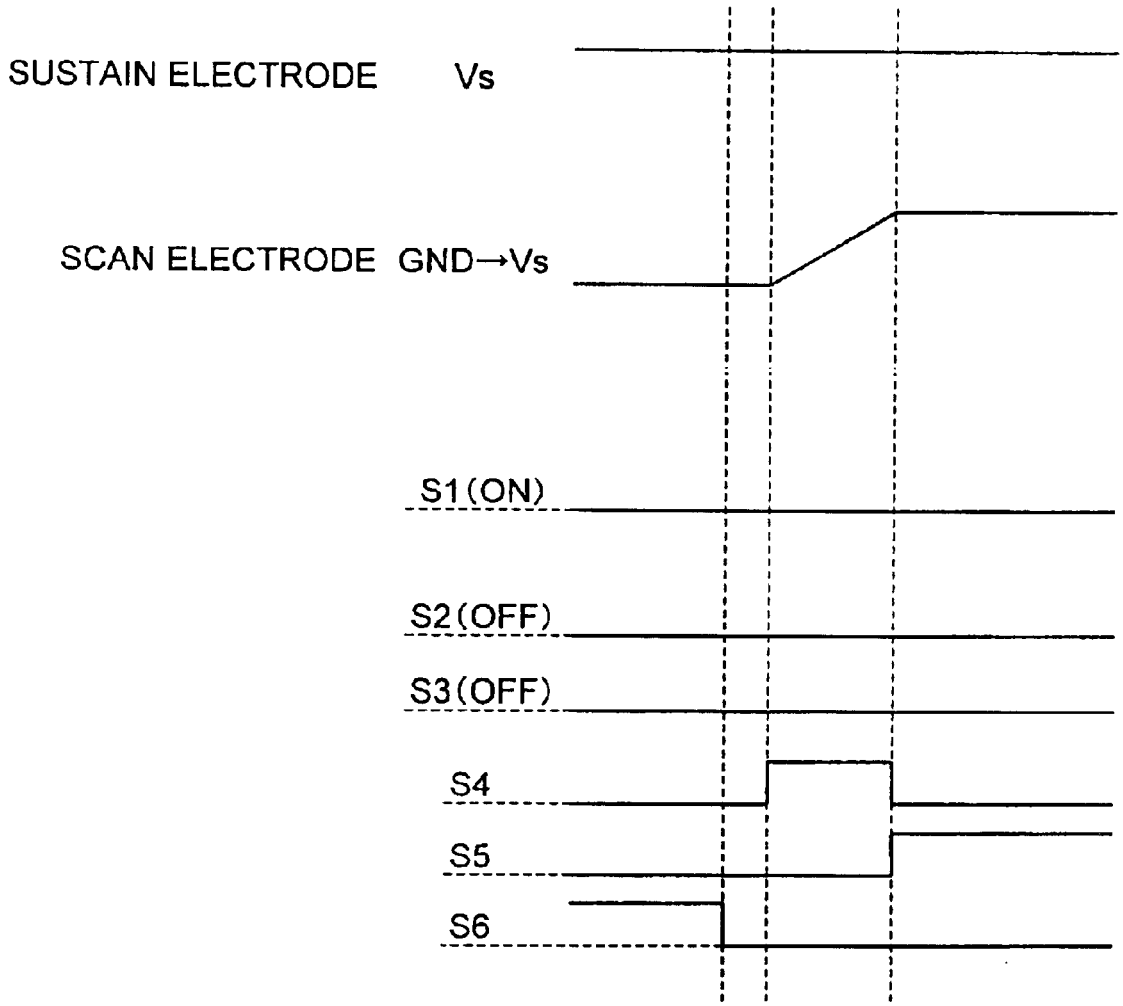
FIG. 9 is a timing chart that shows the potentials of the sustain-electrode and scan-electrode and operations of switches S1 to S6 when the sustain driver circuit and the sustain-electrode driver circuit that are shown in FIG. 6 are used to increase the scan-electrode potential staying at a ground potential to the potential of the power voltage Vs that is the same as the sustain-electrode potential.

FIG. 9 is a timing chart that shows the potentials of the sustain-electrode and scan-electrode and operations of switches S1 to S6 when the sustain driver circuit and the sustain-electrode driver circuit that are shown in FIG. 6 are used to increase the scan-electrode potential staying at a ground potential to the potential of the power voltage Vs that is the same as the sustain-electrode potential.

An initial state is assumed such that each of the switches S1 and S6 is in an ON state. Thereby, the scan-electrode side (point A) is set to the ground potential, and the sustain-electrode (point B) is set to the potential of the power voltage Vs.

In the above initial state, the switches S6 is first set to an OFF state, and the switch S4 is then turned ON. As a result, a current flows from the sustain-electrode side to the scan-electrode side through the switch S4, the diode D2, and the coil L2. Thereby, the scan-electrode potential is slowly increased. The increase in the scan-electrode potential is slow because of effects of the coil L2 and parasitic inductance thereof and inter-panel-electrode capacitance and parasitic capacitance.

After the scan-electrode potential is increased to a certain level, the switch 5 is turned ON, and concurrently, the switch S4 is turned OFF. Thereby, the scan-electrode potential is clamped to the potential of the power voltage Vs.

As described above, according to the present embodiment, to increase the potential on one of the sides of the sustain electrodes and the scan electrodes to the same level of the potential on the other side of the electrodes, the potential clamped in the clamping circuit on the other side of the electrodes is transferred from the one side of the electrode through the charge-collecting circuit to the other side of the electrodes, and the transferred potential is used to slowly vary the potential on the other side of the electrodes. Therefore, slope circuits for slowly varying the potentials are not required.

Figure 2:
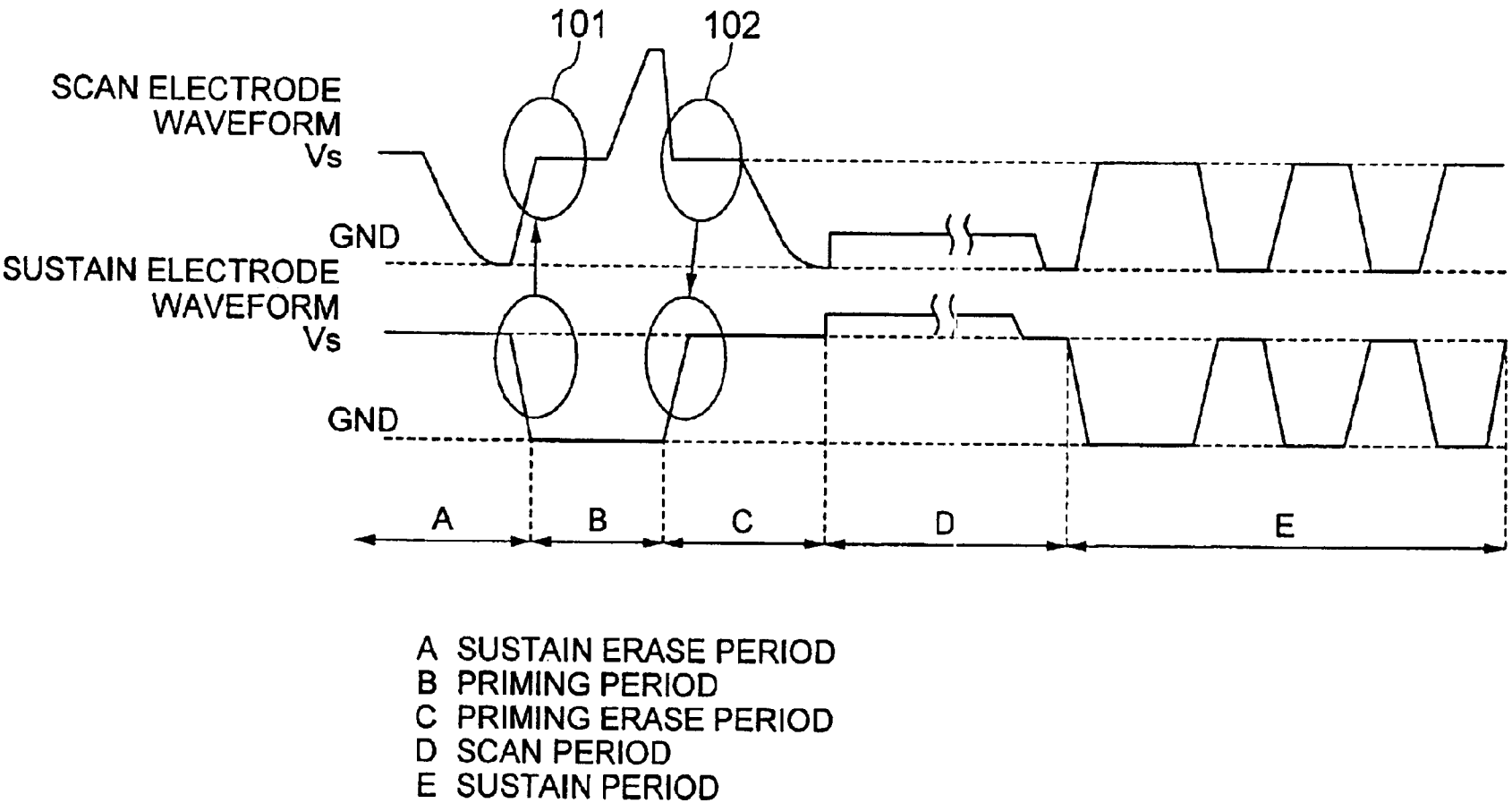
FIG. 2 (PRIOR ART)
FIG. 2 is a timing chart showing timings in a driving method for the plasma display panel shown in FIG. 1.
Figure 3:
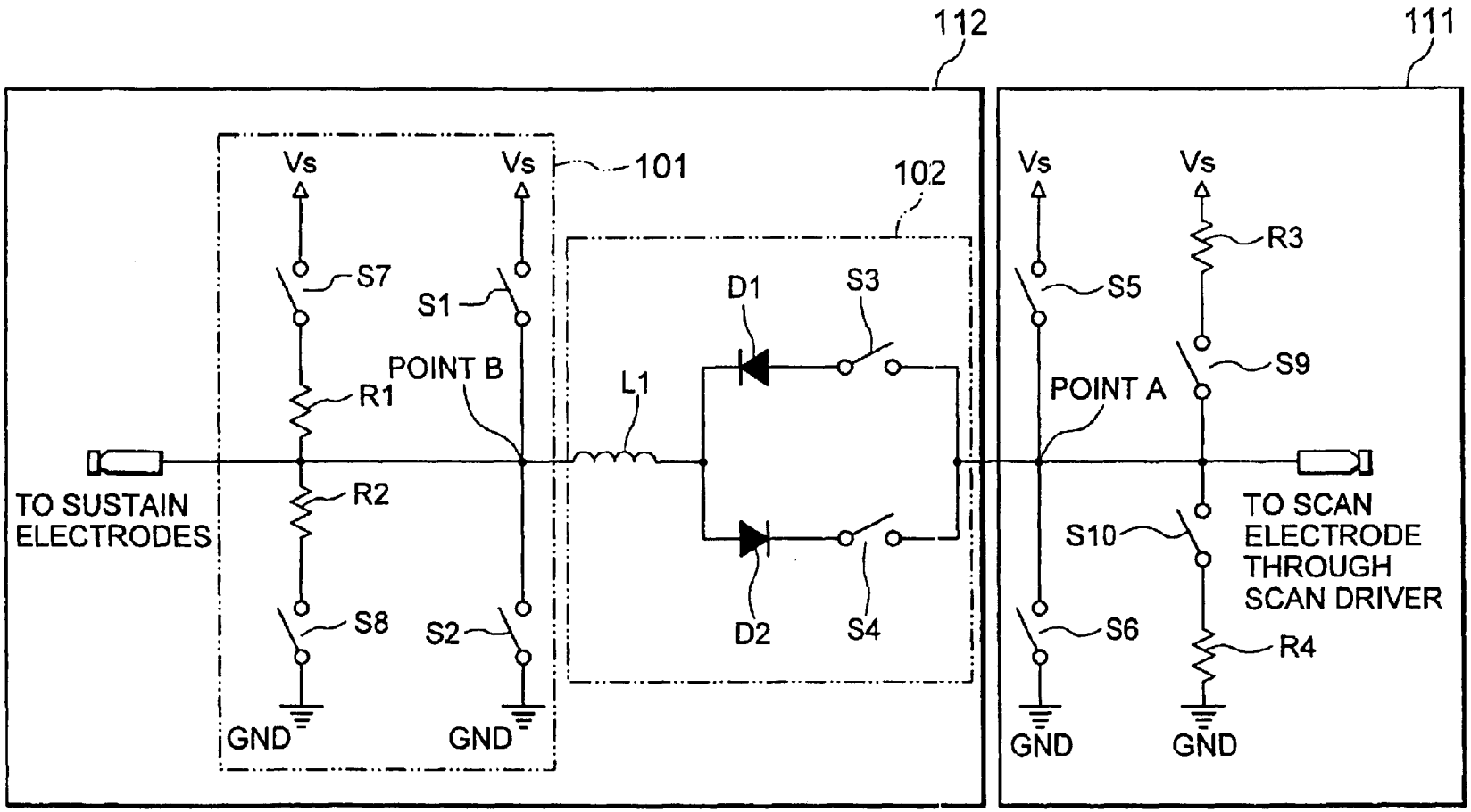
FIG. 3 (PRIOR ART)
FIG. 3 shows circuit diagrams of a conventional sustain driver circuit and sustain-electrode driver circuit of the plasma display panel.
Figure 4:
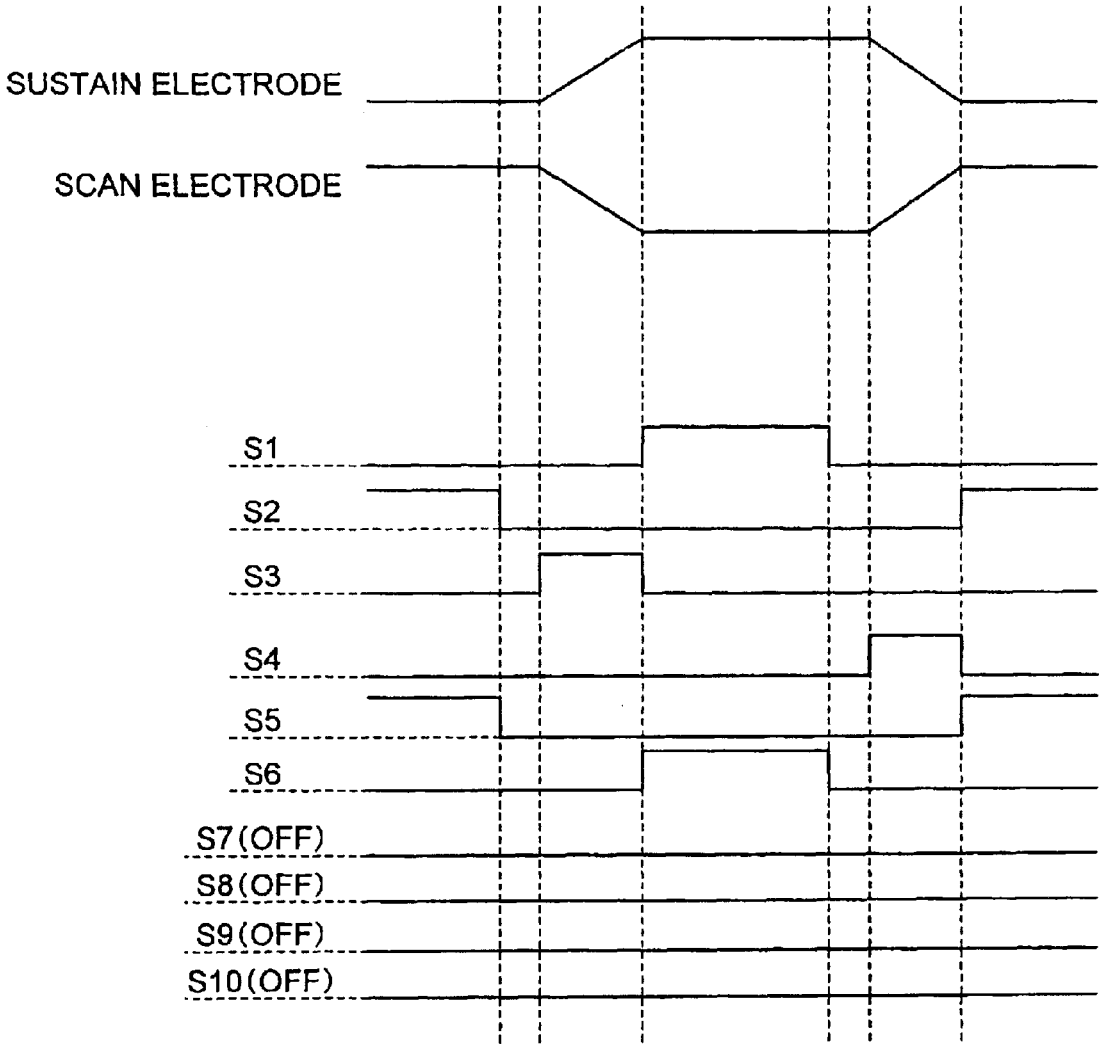
FIG. 4 (PRIOR ART)
FIG. 4 is a timing chart that shows the potentials of the scan-electrode and sustain-electrode and operations of switches S1 to S10 when charge-collection is performed by the sustain driver circuit and the sustain-electrode driver circuit that are shown in FIG. 3.
Figure 5:
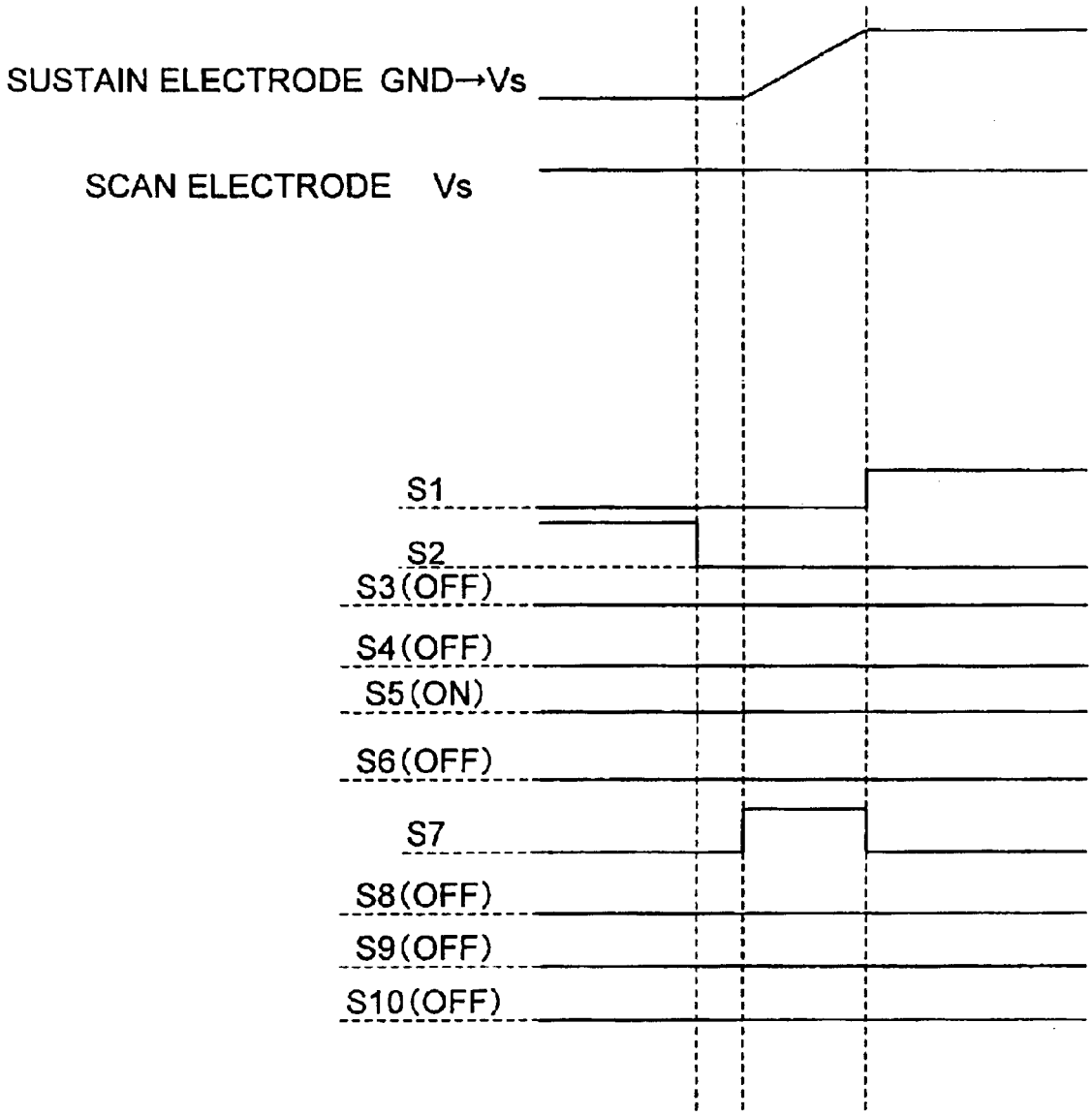
FIG. 5 (PRIOR ART)
FIG. 5 is a timing chart that shows the potentials of the scan-electrode and sustain-electrode and operations of switches S1 to S10 when the sustain driver circuit and the sustain-electrode driver circuit that are shown in FIG. 3 are used to increase the sustain-electrode potential staying at the ground potential to the potential of a power voltage Vs.

By fixing the potential on one side of electrodes, the present embodiment can be used as an aiding means for increasing the potential level of the relative side of opposing side of electrodes to the equal or higher level. That is, the present embodiment can be used in either the sustain erase period or the priming erase period, which are shown in the timing chart shown in FIG. 2 regarding the scan electrodes and the sustain electrodes when the plasma display panel is driven.

Figure 10:
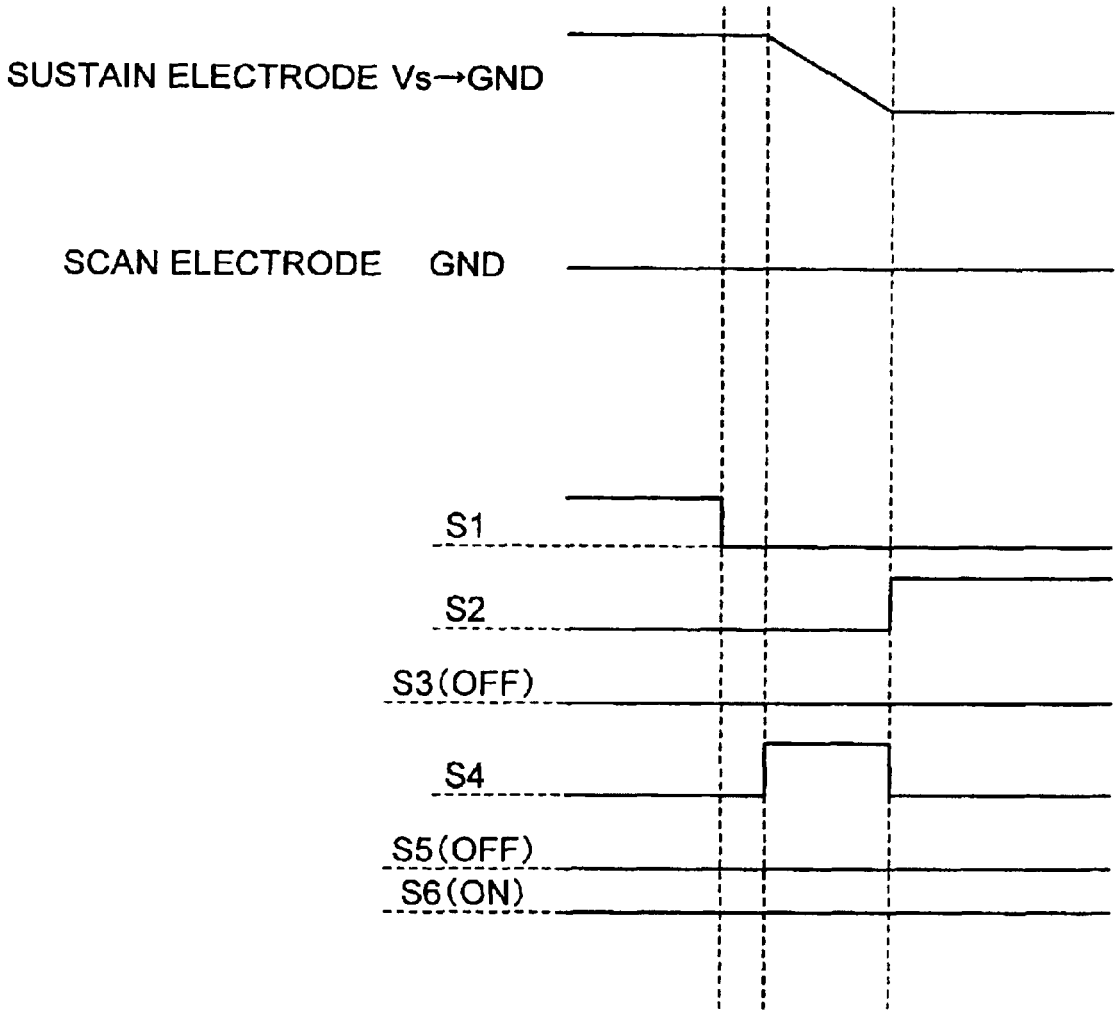
FIG. 10 is a timing chart that shows the potentials of the sustain-electrode and scan-electrode and operations of switches S1 to S6 when the sustain driver circuit and the sustain-electrode driver circuit that are shown in FIG. 6 are used to reduce the sustain-electrode potential staying at the potential of the power voltage Vs to a ground potential that is the same as that on the side of the scan electrodes.

FIG. 10 is a timing chart that shows the potentials of the sustain-electrode and scan-electrode and operations of switches S1 to S6 when the sustain driver circuit and the sustain-electrode driver circuit that are shown in FIG. 6 are used to reduce the sustain-electrode potential staying at the potential of the power voltage Vs to a ground potential that is the same as that on the side of the scan electrodes.

An initial state is assumed such that each of the switches S1 and S6 is in an ON state. Thereby, the scan-electrode side (point A) is set to the ground potential, and the sustain-electrode (point B) is set to the potential of the power voltage Vs.

In the above initial state, the switches S1 is first set to an OFF state, and the switch S4 is then turned ON. As a result, a current flows from the sustain-electrode side to the scan-electrode side through the switch S4, the diode D2, and the coil L2. Thereby, the sustain-electrode potential is slowly reduced. The reduction in the sustain-electrode potential is slow because of effects of the coil L2 and parasitic inductance thereof and inter-panel-electrode capacitance and parasitic capacitance.

After the scan-electrode-potential is reduced to a certain level, the switch 2 is turned ON, and concurrently, the switch 54 is turned OFF. Thereby, the sustain-electrode potential is clamped to the potential of the ground potential.

Figure 11:
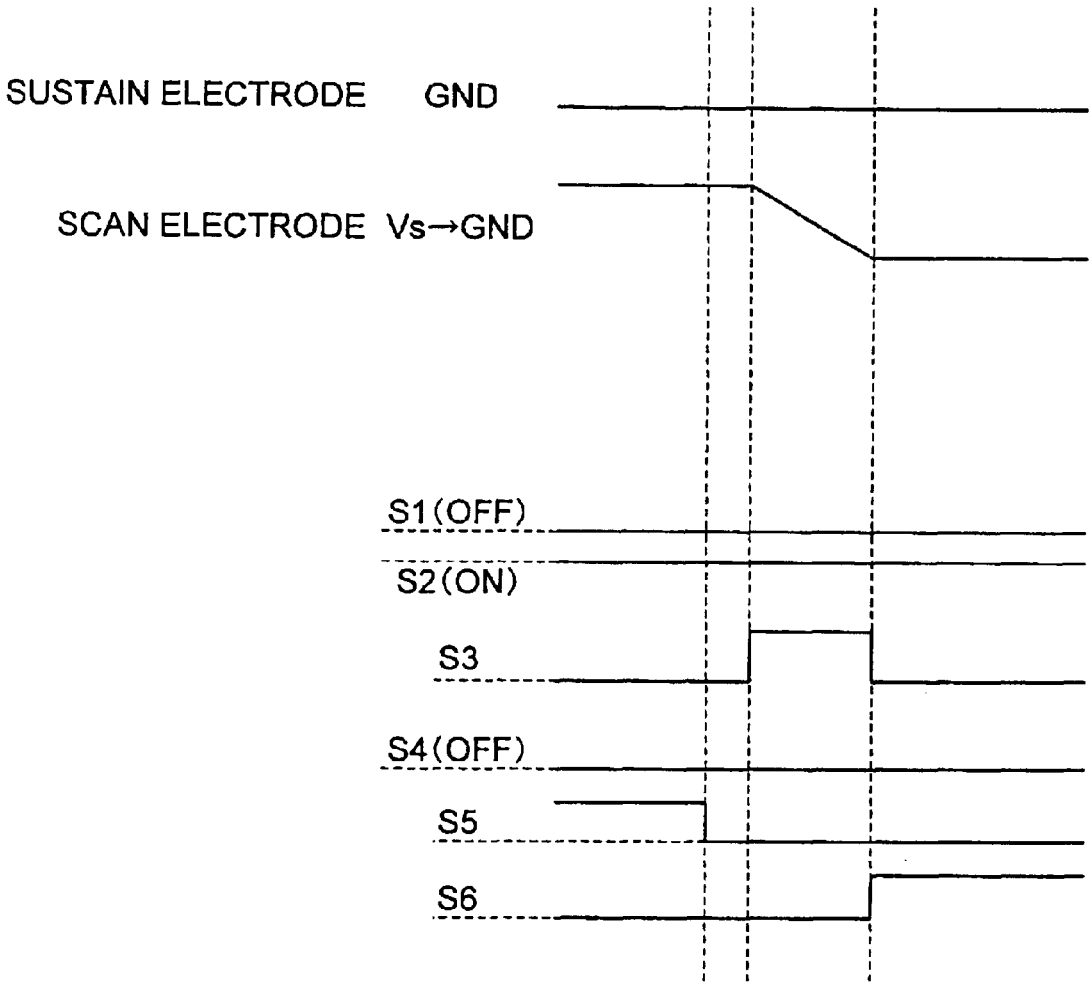
FIG. 11 is a timing chart that shows the potentials of the sustain-electrode and scan-electrode and operations of switches S1 to S6 when the sustain driver circuit and the sustain-electrode driver circuit that are shown in FIG. 6 are used to reduce the scan-electrode potential staying at the potential of the power voltage Vs to the ground potential that is the same as the sustain-electrode potential.

FIG. 11 is a timing chart that shows the potentials of the sustain-electrode and scan-electrode and operations of switches S1 to S6 when the sustain driver circuit and the sustain-electrode driver circuit that are shown in FIG. 6 are used to reduce the scan-electrode potential staying at the potential of the power voltage Vs to the ground potential that is the same as the sustain-electrode potential.

An initial State is assumed such that each of the switches S2 and S5 is in an ON state. Thereby, the scan-electrode side (point A) is set to the potential of the power voltage Vs, and the sustain-electrode (point B) is set to the ground potential.

In the above initial state, the switches S5 is first set to an OFF state, and the switch S3 is then turned ON. As a result, a current flows from the scan-electrode side to the sustain-electrode side through the coil L1, the diode D1, and the switch S3. Thereby, the scan-electrode potential is slowly reduced. The reduction in the scan-electrode potential is slow because of effects of the coil L1 and parasitic inductance thereof and inter-panel-electrode capacitance and parasitic capacitance.

After the scan-electrode potential is reduced to a certain level, the switch 6 is turned ON, and concurrently, the switch S3 is turned OFF. Thereby, the scan-electrode potential is clamped to the ground potential.

As described above, according to the present embodiment, to reduce the potential on one of the sides of the sustain electrodes and the scan electrodes to the same level of the potential of the other side of the electrodes, a current is applied to flow from the one side of the electrodes through the charge-collecting circuit to the other side of the electrodes to thereby slowly vary the potential on the other side of the electrodes. Therefore, slope circuits for slowly varying the potentials are not required.

For each of the switches S1 to S6, for example, a field effect transistor (FET) may be used.

Moreover, the coils L1 and L2 may be moved within the circuit line, and a non-coil material having a predetermined inductance value may be used therefor.

In a case where oscillations and falls of potentials are caused by the coils L1 and L2 and parasitic inductance, it is effective to insert clamp diodes within a practical voltage range.

As described above, the present embodiment avoids the necessity for the provision of slope circuits that function to cause slow variations in potentials. Therefore, the sustain driver circuit can be configured to include only one of the clamping circuits 1 and 3 to thereby simplify the configuration. Accordingly, reduction in the costs can be implemented. Moreover, according to the simplification in the configuration, the flexibility in installation spaces is increased to enable optimized disposition of circuit elements to be implemented, Furthermore, since the number of circuits is reduced, control signals can be reduced.

What is claimed is:

1. A driving method for a plasma display panel, said plasma display panel comprising:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit that has a first switching element for clamping a first electrode which is one of said scan electrodes and said sustain electrodes to a power potential and a second switching element for clamping said first electrode to a ground potential, and that clamps said first electrode to a predetermined potential;

a second clamping circuit that comprises a fifth switching element for clamping a second electrode which is the other one of said scan electrodes and said sustain electrodes to a power potential and a sixth switching element for clamping said second electrode to a ground potential, and that clamps said second electrode to a predetermined potential; and a charge-collecting circuit that comprises a first circuit line and a second circuit line, said first circuit line being formed to include a first coil, a first diode, and a third switching element that series-connected to each other and to thereby allow a current to flow from said second clamping circuit to said first clamping circuit, and said second circuit line being formed to include a second coil, a second diode, and a fourth switching element which are series-connected to each other and to thereby allow a current to flow to said second clamping circuit, and that is connected between said first clamping circuit and said second clamping circuit in parallel to an inter-electrode capacitance between said first electrode and said second electrode, thereby performs charge-collection between said scan electrodes and said sustain electrodes;

said driving method wherein after a write-discharge is generated between said scan electrode and said data electrode at said display cell, a voltage is applied to said scan electrode and said sustain electrode to thereby sustain said discharge, comprising;

transferring the potential clamped in said second clamping circuit to said first electrode through said charge-collecting circuit to thereby vary the potential of the first electrode to the same level of the potential as that of said second electrode, wherein, when the potential of said first electrode stays at the ground potential, and the potential of said second electrode stays at the power potential, said driving method comprising the steps of:

setting said second switching element to an OFF state;

setting said third switching element to an ON state to thereby allow a current to flow to said first circuit line; and setting said first switching element to an ON state to thereby increase the potential of said first electrode to the level of the power potential.

2. A driving method for a plasma display panel, said plasma display panel comprising:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit that has a first switching element for clamping a first electrode which is one of said scan electrodes and said sustain electrodes to a power potential and a second switching element for clamping said first electrode to a ground potential, and that clamps said first electrode to a predetermined potential;

a second clamping circuit that comprises a fifth switching element for clamping a second electrode which is the other one of said scan electrodes and said sustain electrodes to a power potential and a sixth switching element for clamping said second electrode to a ground potential, and that clamps said second electrode to a predetermined potential; and a charge-collecting circuit that comprises a first circuit line and a second circuit line, said first circuit line being formed to include a first coil, a first diode, and a third switching element that series-connected to each other and to thereby allow a current to flow from said second clamping circuit to said first clamping circuit, and said second circuit line being formed to include a second coil, a second diode, and a fourth switching element which are series-connected to each other and to thereby allow a current to flow to said second clamping circuit, and that is connected between said first clamping circuit and said second clamping circuit in parallel to an inter-electrode capacitance between said first electrode and said second electrode, thereby performs charge-collection between said scan electrodes and said sustain electrodes;

said driving method wherein after a write-discharge is generated between said scan electrode and said data electrode at said display cell, a voltage is applied to said scan electrode and said sustain electrode to thereby sustain said discharge, comprising;

transferring the potential clamped in said second clamping circuit to said first electrode through said charge-collecting circuit to thereby vary the potential of the first electrode to the same level of the potential as that of said second electrode, wherein, when the potential of said first electrode stays at the power potential, and the potential of said second electrode stays at the ground potential, said driving method comprising the steps of:

setting said sixth switching element to an OFF state;

setting said fourth switching element to an ON state to thereby allow a current to flow to said second circuit line; and setting said fifth switching element to an ON state to thereby increase the potential of said second set of electrode to the level of the power potential.

3. A driving method for a plasma display panel, said plasma display panel comprising:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit that has a first switching element for clamping a first electrode which is one of said scan electrodes and said sustain electrodes to a power potential and a second switching element for clamping said first electrode to a ground potential, and that clamps said first electrode to a predetermined potential;

a second clamping circuit that comprises a fifth switching element for clamping a second electrode which is the other one of said scan electrodes and said sustain electrodes to a power potential and a sixth switching element for clamping said second electrode to a ground potential, and that clamps said second electrode to a predetermined potential; and a charge-collecting circuit that comprises a first circuit line and a second circuit line, said first circuit line being formed to include a first coil, a first diode, and a third switching element that series-connected to each other and to thereby allow a current to flow from said second clamping circuit to said first clamping circuit, and said second circuit line being formed to include a second coil, a second diode, and a fourth switching element which are series-connected to each other and to thereby allow a current to flow to said second clamping circuit, and that is connected between said first clamping circuit and said second clamping circuit in parallel to an inter-electrode capacitance between said first electrode and said second electrode, thereby performs charge-collection between said scan electrodes and said sustain electrodes;

said driving method wherein after a write-discharge is generated between said scan electrode and said data electrode at said display cell, a voltage is applied to said scan electrode and said sustain electrode to thereby sustain said discharge, comprising;

transferring the potential clamped in said second clamping circuit to said first electrode through said charge-collecting circuit to thereby vary the potential of the first electrode to the same level of the potential as that of said second electrode, wherein, when the potential of said first electrode stays at the power potential, and the potential of said second electrode stays at the ground potential, said driving method comprising the steps of:

setting said first switching element to an OFF state;

setting said fourth switching element to an ON state to thereby allow a current to flow to said second circuit line; and setting said second switching element to an ON state to thereby reduce the potential said first set of electrode to ground potential.

4. A driving method for a plasma display panel, said plasma display panel comprising:

a panel having: a plurality of scan electrodes that extend in a row direction; a plurality of sustain electrodes that extend parallel to and in pairs with said scan electrodes and that form display lines as a space between said sustain electrode and said scan electrode disposed adjacent thereto; a plurality of data electrodes that extend in a columnar direction which is perpendicular to the direction along which said scan electrodes and said sustain electrodes extend; display cells formed at cross points of said scan electrodes and said data electrodes;

a first clamping circuit that has a first switching element for clamping a first electrode which is one of said scan electrodes and said sustain electrodes to a power potential and a second switching element for clamping said first electrode to a ground potential, and that clamps said first electrode to a predetermine potential;

a second clamping circuit that comprises a fifth switching element for clamping a second electrode which is the other one of said scan electrodes and said sustain electrodes to a power potential and a sixth switching element for clamping said second electrode to a ground potential, and that clamps said second electrode to a predetermined potential; and a charge-collecting circuit that comprises a first circuit line and a second circuit line, said first circuit line being formed to include a first coil, a first diode, and a third switching element that series-connected to each other and to thereby allow a current to flow from said second clamping circuit to said first clamping circuit, and said second circuit line being formed to include a second coil, a second diode, and a fourth switching element which are series-connected to each other and to thereby allow a current to flow to said second clamping circuit, and that is connected between said first clamping circuit and said second clamping circuit in parallel to an inter-electrode capacitance between said first electrode and said second electrode, thereby performs charge-collection between said scan electrodes and said sustain electrodes;

said driving method wherein after a write-discharge is generated between said scan electrode and said data electrode at said display cell, a voltage is applied to said scan electrode and said sustain electrode to thereby sustain said discharge, comprising;

transferring the potential clamped in said second clamping circuit to said first electrode through said charge-collecting circuit to thereby vary the potential of the first electrode to the same level of the potential as that of said second electrode, wherein, when the potential of said first electrode stays at the ground potential, and the potential of said second electrode stays at the power potential, said driving method comprising the steps of:

setting said fifth switch device to an OFF state;

setting said third switching element to an ON state to thereby allow a current to flow to said first circuit line; and setting said sixth switching element to an ON state to thereby reduce the potential of said second electrode to the level of the power ground potential.

* * * * *